US007410348B2

(12) United States Patent
Chalk et al.

(10) Patent No.: US 7,410,348 B2
(45) Date of Patent: Aug. 12, 2008

(54) MULTI-SPEED COMPRESSOR/PUMP APPARATUS

(75) Inventors: David Jonathan Chalk, Slatington, PA (US); David John Farese, Riegelsville, PA (US)

(73) Assignee: Air Products and Chemicals, Inc., Allentown, PA (US)

( * ) Notice: Subject to any disclaimer, the term of this patent is extended or adjusted under 35 U.S.C. 154(b) by 377 days.

(21) Appl. No.: 11/195,936

(22) Filed: Aug. 3, 2005

(65) Prior Publication Data

US 2007/0028628 A1 Feb. 8, 2007

(51) Int. Cl.

| | |
|---|---|
| ***F04B 37/08*** | (2006.01) |
| ***F04B 15/02*** | (2006.01) |
| ***F04B 53/10*** | (2006.01) |
| ***F04B 53/12*** | (2006.01) |

(52) U.S. Cl. ..... 417/555.1; 62/50.6; 62/50.7; 417/256; 417/434; 417/435; 417/553; 417/556; 417/901

(58) Field of Classification Search ..... 417/555.1, 417/437, 254, 545, 434, 435, 901, 256, 259, 417/488, 553, 556; 73/488; 62/50.6, 50.7
See application file for complete search history.

(56) References Cited

U.S. PATENT DOCUMENTS

| | | | | |
|---|---|---|---|---|
| 3,181,473 | A * | 5/1965 | Duron | 417/435 |
| 4,447,195 | A | 5/1984 | Schuck | |
| 5,243,821 | A * | 9/1993 | Schuck et al. | 62/50.6 |
| 5,411,374 | A * | 5/1995 | Gram | 417/53 |
| 5,575,626 | A * | 11/1996 | Brown et al. | 417/251 |
| 5,884,488 | A * | 3/1999 | Gram et al. | 62/50.6 |
| 5,947,854 | A | 9/1999 | Kopko | |
| 6,171,074 | B1 | 1/2001 | Charron | |
| 6,273,674 | B1 | 8/2001 | Charron | |
| 6,296,690 | B1 | 10/2001 | Charron | |
| 6,530,761 | B1 * | 3/2003 | Chalk et al. | 417/552 |
| 6,640,556 | B2 | 11/2003 | Ursan et al. | |
| 6,659,730 | B2 * | 12/2003 | Gram et al. | 417/53 |
| 2005/0163642 | A1 * | 7/2005 | Duron | 417/901 |
| 2005/0180869 | A1 * | 8/2005 | Ursan et al. | 417/440 |

* cited by examiner

*Primary Examiner*—Devon Kramer
*Assistant Examiner*—Leonard J Weinstein
(74) *Attorney, Agent, or Firm*—Keith D. Gourley

(57) ABSTRACT

A pumping/compressing apparatus for use in a fluid handling system transferring a fluid from one location, e.g., a tank, to another location or to an end use is provided. The apparatus basically includes a motor and a multistage, e.g., two stage, device including at least one reciprocating piston, an inlet stage chamber, an outlet stage chamber, an inlet, and an outlet. The piston is arranged to be reciprocated at multiple, e.g., respective first and second, speeds. The second speed is higher than the first speed, whereupon when the piston is reciprocated at the first speed the device effectively pumps liquid or mostly liquid to the outlet. When the piston is reciprocated at the second speed the device effectively compresses gas or mostly gas fluid and provides it to the outlet. A blowby port may be provided to provide blowby fluid back to the tank or the device.

12 Claims, 4 Drawing Sheets

MULTI-SPEED COMPRESSOR/PUMP APPARATUS

BACKGROUND OF THE INVENTION

This invention relates generally to systems for transferring fluids, e.g., cryogenic fluids, from a vessel to another location or an end user and more particularly to apparatus that can be used in a low pressure cryogenic storage system for pumping a liquid, compressing a gas or pumping/compressing a combination of liquid and gas at high pressure, with the speed of operation of the apparatus being variable depending on the type of fluid being transferred.

Cryogenic fluids, such as liquified hydrogen, oxygen, nitrogen, argon or liquified air, and liquified hydrocarbons, such as liquified methane, butane, propane or natural gas, are typically stored and transported in pressurized containers. The containers are typically well-insulated and refrigerated to very low temperatures. While many types of pumps/compressors have been designed for transferring fluids between containers or from one container to a point of use, mechanical pumps of the reciprocating piston type have been preferred for many applications. Such pumps/compressors usually make use of a motor having a rotary output shaft for driving or reciprocating the piston.

As will be appreciated by those skilled in the art the term "pump" is generally used in the context of liquid handling, wherein the operation of a "pump" increases the pressure on the liquid. The term "compressor" on the other hand is generally used in the context of gas handling, wherein the operation of a "compressor" increases the pressure on the gas. A problem with utilizing a compressor as a pump, or visa versa, stems from the restriction of the pump valves to fluid flow. For a given reciprocating speed, liquid flow through the pump valves will have a much higher pressure drop when compared to gas flow. To make the valves work properly for gas flow, the valves will be too small and restrictive when used for liquid flow. The solution is to control the phase of the fluid going into the pump along with pump rotational speed. If only gas is admitted, the compressor can run at a higher speed compared to if liquid is admitted to the pump.

A second problem arises when considering the power required for pumping a liquid as compared to compressing a gas. For any given rotational speed, the pump will need much more power than a compressor. A variable speed motor does not resolve this issue, since the power a variable speed motor puts out is directly proportional to rotational speed. Thus, at low rotational speed, where liquid must be pumped, the power required is highest, but the motor's power output is lowest.

A third problem regards the control of piston ring blowby gas. For a cryogenic pump being used for liquid, blowby liquid will flash and at least partially convert to a gas. If this blowby fluid is routed back to the pump suction, the gas displaces some liquid, thus reducing the flow rate of the pump which may be seen as a detriment to system performance. If the reciprocating machine is being used to compress a gas, there may be a negligible effect on system performance if this blowby gas is re-ingested. Thus routing of blowby gas in a system which uses a single machine to pump liquid and also to compress gas is a concern, and a method of controlling blowby is beneficial.

In order to pump a liquid or mostly liquid fluid, the rotational or reciprocating speed of the motor driving a reciprocating piston pump should be relatively low, e.g., 600 rpm or less, primarily due to the pump's valves and its power requirements. To compress a gas, or mostly gas fluid, a reciprocating piston compressor will benefit from a higher rotational or reciprocating speed, e.g., 1200 rpm.

Because boiling and vaporizing of a cryogenic liquid in a storage tank results in a gas which must be dealt with, various techniques have been proposed for pumping the liquid and compressing the gas. For example, one technique of the prior art focuses on separating the liquid from the gas, and pumping/compressing each component separately using different devices. In U.S. Pat. Nos. 6,171,074 (Charron), U.S. Pat. No. 6,273,674 (Charron), and U.S. Pat. No. 6,296,690 (Charron) there are disclosed various methods and apparatus for separating a mixture of liquid and gas in oil field applications. In the case of a cryogenic tank, heat from the environment causes some of the liquid to boil off, thereby increasing the tank pressure unless the gas is vented. In such a tank, the mixture of gas and liquid may be controlled by piping vapor (gas) from the top of the tank and liquid from the bottom of the tank. In such an arrangement, the ability to compress excess gas in the tank in order to prevent over pressurization and loss of product by venting is highly desirable. To that end, U.S. Pat. No. 4,447,195 (Schuck), U.S. Pat. No. 5,243,821 (Schuck et al.) and U.S. Pat. No. 6,640,556 (Ursan et al.) describe methods of mixing vapor with liquid.

While the above patents appear generally suitable for their intended purposes, they never the less leave much to be desired from the standpoint of their ability to deliver a cryogenic product as well as conserving and reducing venting and associated wastage of the product. A single reciprocating piston device capable of handling both liquid and gas of a cryogenic product is thus desirable. Unfortunately, prior to the subject invention there hasn't been a single pump/compressor apparatus that can accomplish the desired pumping/compressing of a liquid/gas on a viable, cost effective basis.

As will be seen from the discussion to follow, the subject invention accomplishes those ends by a simple methodology, e.g., changing the reciprocating speed of the pump/compressor to accommodate the particular fluid being pumped. Changing the operating speed of a pump or fan has been described in U.S. Pat. No. 5,947,854 (Kopko), but not in the context of pumping/compressing two different phase fluids.

SUMMARY OF THE INVENTION

One aspect of this invention entails a pumping/compressing apparatus for use in a fluid handling system. Another aspect of this invention relates to the fluid handling system including the pumping/compressing apparatus. The fluid handling system comprises a vessel for holding the fluid, i.e., a liquid, gas and/or combination thereof, a vapor valve and a liquid valve, and is arranged for transferring the fluid from one location, e.g., a storage tank or vessel, to another location or to an end user. The tank is coupled to the vapor valve and to the liquid valve, and to the pumping/compressing apparatus.

The pumping/compressing apparatus basically comprises a multistage, e.g., two stage, device and a motor. The vapor valve and the liquid valve are coupled to the two stage device, whereupon gas from the tank may flow to the multistage device via the vapor valve and liquid from the vessel may flow to the device via the liquid valve. The multistage device is arranged for pumping and/or compressing the fluid and basically comprises at least one reciprocating piston, an inlet stage chamber, an outlet stage chamber, an inlet, and an outlet. The inlet is coupled to the inlet stage chamber. The outlet is coupled to the outlet stage chamber. The at least one piston includes a portion in communication with the inlet stage chamber. The inlet stage chamber is arranged to be coupled in fluid communication to the outlet stage chamber. The at least one piston is coupled to the motor, e.g., a variable speed motor or a single speed motor with a transmission, and is arranged to be reciprocated thereby at multiple speeds comprising at least respective first and second speeds. The second reciprocating speed is higher than the first reciprocating speed, whereupon when the at least one piston is reciprocated at the first reciprocating speed the multistage device can effectively pump liquid or mostly liquid fluids from the outlet stage chamber to the outlet and when the piston is reciprocated at the second reciprocating speed the multistage device can effectively compress gas or mostly gas fluids in the outlet stage chamber and provide the gas or mostly gas fluids to the outlet.

In accordance with another aspect of this invention the fluid handling system may optionally also include a blowby valve that is coupled to the vessel and to the inlet of the multistage device. In such an arrangement the multistage device includes a hollow interior portion and a blowby port in communication therewith. The at least one piston includes at least one piston seal selectively isolating the inlet stage chamber from the blowby port. The at least one piston seal is arranged to selectively operate to enable a blowby portion of the fluid in the outlet stage chamber to flow to the hollow interior portion and the blowby port. The blowby port of the multistage device is coupled to the inlet of the multistage device and to the blowby valve to enable blowby fluid to flow back to the vessel and to the inlet of the multistage device for reuse.

DETAILED DESCRIPTION OF THE PREFERRED EMBODIMENT

Figure 1:
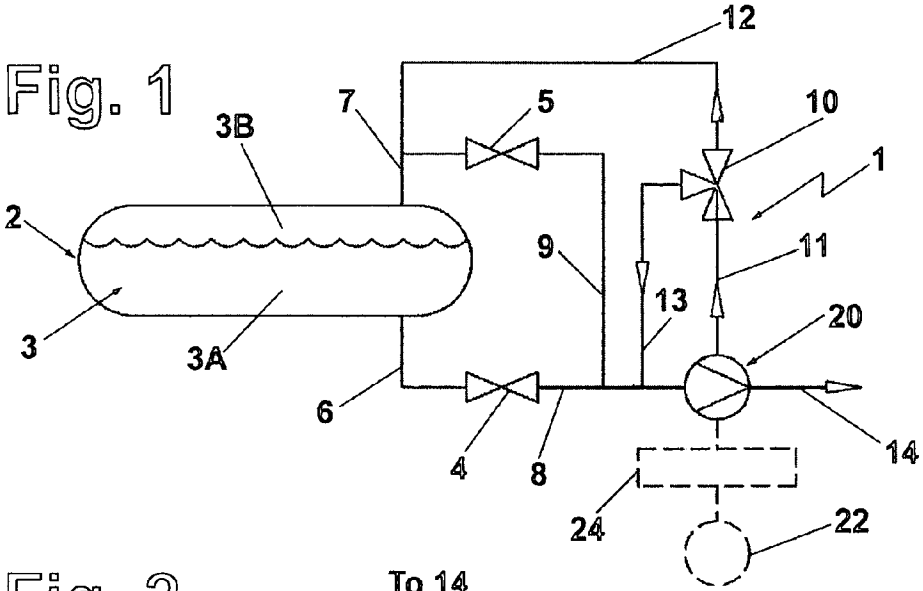
FIG. 1 is a schematic diagram of one exemplary fluid handling system constructed in accordance with this invention and using a pumping-compressing apparatus constructed in accordance with this invention.

Referring now to the various figures of the drawing wherein like reference numbers refer to like parts, there is shown one exemplary system 1 making use of a two stage pumping-compressing apparatus 20 constructed in accordance with this invention. The system 1 is exemplary of various systems that are arranged to move or provide a fluid, e.g., a cryogenic fluid, to some component. In the exemplary embodiment shown, the system 1 comprises a storage tank or vessel 2, in which a cryogenic fluid 3 is located. The fluid in the tank may be in all liquid form, in all gas form, but more likely is in the form of a combination of a liquid 3A and a gas or vapor 3B. The gas, being lighter than the liquid, will typically reside above the liquid in the tank. In order to transport the fluid 3 (be it liquid, gas or a combination of the two) to some other piece of equipment, e.g., another storage vessel or to equipment (not shown) for using the fluid, the system 1 includes the heretofore identified pumping-compressing apparatus 20, a pair of valves 4 and 5 and associated pipes or conduits (to be described shortly). The valves 4 and 5 are arranged for carrying the liquid 3A and the gas 3B, respectively, to the pumping-compressing apparatus 20. To that end, the valves 4 and 5 are each a conventional device and they are coupled to the tank 2 via conventional pipes or conduits as shown in FIG. 1. The valves 4 and 5 are also coupled to the inlet (input) of the pumping-compressing apparatus 20 by conventional pipes or conduits 8 and 9, respectively, as also shown in FIG. 1.

In accordance with one preferred aspect of this invention, the system 1 may include a conventional blowby valve 10. The valve 10 has an input connected to a pipe or conduit 11 from a port (to be described later) of the pumping-compressing apparatus 20. The blowby valve 10 includes a pair of outlets, one of which is connected via a pipe or conduit 12 back to the tank 2, e.g., the upper portion of the tank where the gas phase 3A of the fluid 3 resides. The other outlet of the blowby valve 10 is connected via a pipe or conduit 13 back to the inlet of the pumping-compressing apparatus 20. The details of the operation of the blowby valve 10 will be described later. The outlet of the pumping-compressing apparatus 20 is provided to pipe or conduit 14 and from there to some other device or equipment, e.g., another storage tank, etc. (not shown).

The pumping-compressing apparatus 20 basically comprises a multistage, e.g., two stage, device that is particularly useful for pumping cryogenic fluids, e.g., fluids in the range of approximately −150.degree. C. to approximately −273.degree. C. While the apparatus 20 will be described hereinafter focusing on cryogenic fluids, it should be clear to those skilled in the art, that it also may be used with other types of fluids, that may be liquids, gases, or combinations of liquid and gas. For example, the apparatus 20 could be used with relatively cold fluids having temperatures higher than the temperatures of "cryogenic fluids," but which would change phase in the system in a manner similar to that of cryogenic fluids. In fact, the apparatus 20 has many uses, including but not limited to use in the system and method discussed in our U.S. Pat. No. 6,474,078 (Chalk et al.) which is assigned to the same assignee as this invention and whose disclosure is incorporated by reference herein.

In our U.S. Pat. No. 6,530,761 (Chalk et al.), which is assigned to the same assignee as this invention and whose disclosure is incorporated by reference herein, there is disclosed a reciprocating pump including a housing, a piston slideably mounted within the housing for a reciprocating movement, a shaft connected to the piston and adapted for reciprocating movement concurrently with the piston, an inlet valve, a discharge valve, and an interstage valve. A first chamber on one side of the piston is in fluid communication with an inlet and a second chamber on the opposite side of the piston is in fluid communication with a discharge. The first and second chambers are in fluid communication with each other. At least part of the shaft is in the second chamber. The interstage valve controls the fluid flowing from the first chamber to the second chamber and is closed during a suction stroke and is open during a compression stroke. The two stage device of this invention exhibits several of the features of the two stage device of that patent.

The operation of the subject multistage device is effected by means of a motor 22 (to be described later) which may constitute a portion of the pumping-compressing apparatus 20 itself or be a separate component, e.g., a portion of the system 1. The motor is shown by phantom lines in FIG. 1 and is arranged to drive or power the two stage device. In particular, the exemplary two stage device shown includes a piston (to be described later) which is arranged to be reciprocated by the motor 22. If the output of the motor is rotary, as will typically be the case, the system 1 includes some means (not shown) for translating that rotary output motion of the motor to reciprocating motion. Since the pumping-compressing apparatus 20 is arranged to be operated at different speeds, depending on the phase of the fluid being handled, the motor 22 can be a variable speed motor. Alternatively, the motor may be a single speed motor, whose output is coupled to the piston of the device via a variable transmission 24 (also shown by phantom lines in FIG. 1).

Figure 2:
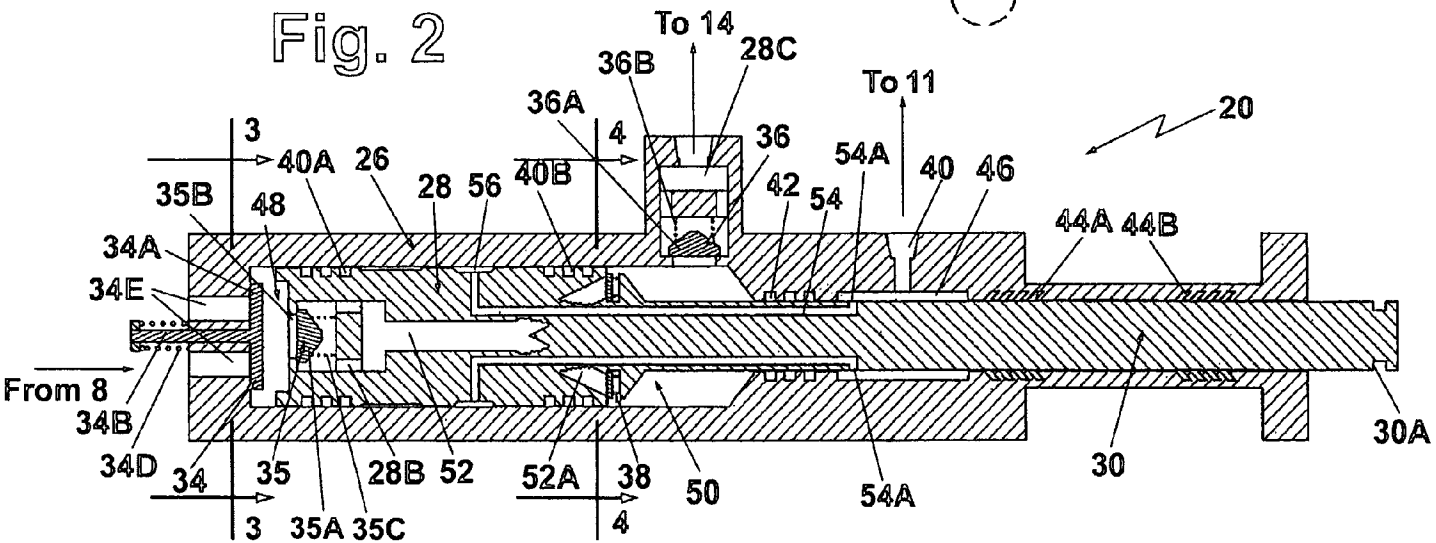
FIG. 2 is a longitudinal sectional view of one exemplary multistage, e.g., two stage, device of the pumping-compressing apparatus constructed in accordance with this invention.

Referring now to FIG. 2, the details of the multistage device of the pumping-compressing apparatus 20 will now be described. To that end the exemplary multistage device shown is a two stage device that basically comprises a cylindrically shaped housing 26, a reciprocating piston head 28 located within a cylindrically shaped chamber in the housing, a piston shaft 30 connected to the reciprocating piston 28. The device also includes an inlet having a valve 34 located at one end of the housing 26, a first stage discharge valve 35, an outlet having a second stage discharge valve 36 located at an intermediate portion of the housing, a second or interstage suction valve 38, and a blowby port 40 located between the second stage discharge valve and the opposite end of the housing 26. It should be pointed out at this juncture that the shape of the housing is not limited to being cylindrical, but can be of other shapes if desired. Moreover the location of the different components making up the device vis-á-vis one another need not be as shown, since other arrangements are contemplated. In any case, the piston head is arranged to be driven in a reciprocating motion by a motor. If the output of the motor is rotary, a mechanism often referred to as the drive end or warm end is provided to translate the rotary motion of the motor to reciprocating motion for the two stage device. Thus, the free end 30A of the piston shaft 30 is arranged to be connected to such a mechanism.

Fluid 3 from the valves 4 and/or 5 enters the inlet valve 34 of the apparatus 20 at a lower pressure and leaves the discharge outlet valve 36 at a higher pressure. Sealing means between the inner walls of the housing 26 and the outer surface of the piston head 28 are provided by piston rings 40A and 40B mounted on the piston head 28. Sealing means are also provided between the inner walls of the housing 26 and the outer surface of the piston shaft 30. These means constitute high pressure shaft seals 42 and low pressure shaft seals 44A and 44B. The blowby port 40 is in communication with an annular space 46 located in a portion of the wall of the housing 26 adjacent the shaft 30 and provides a means for vapor to return to either the inlet 34 (suction side) of the device via conduit 11, blowby valve 10 and conduit 13 or to the storage tank 2, via conduit 11, blowby valve 10 and conduit 12.

Figure 5:
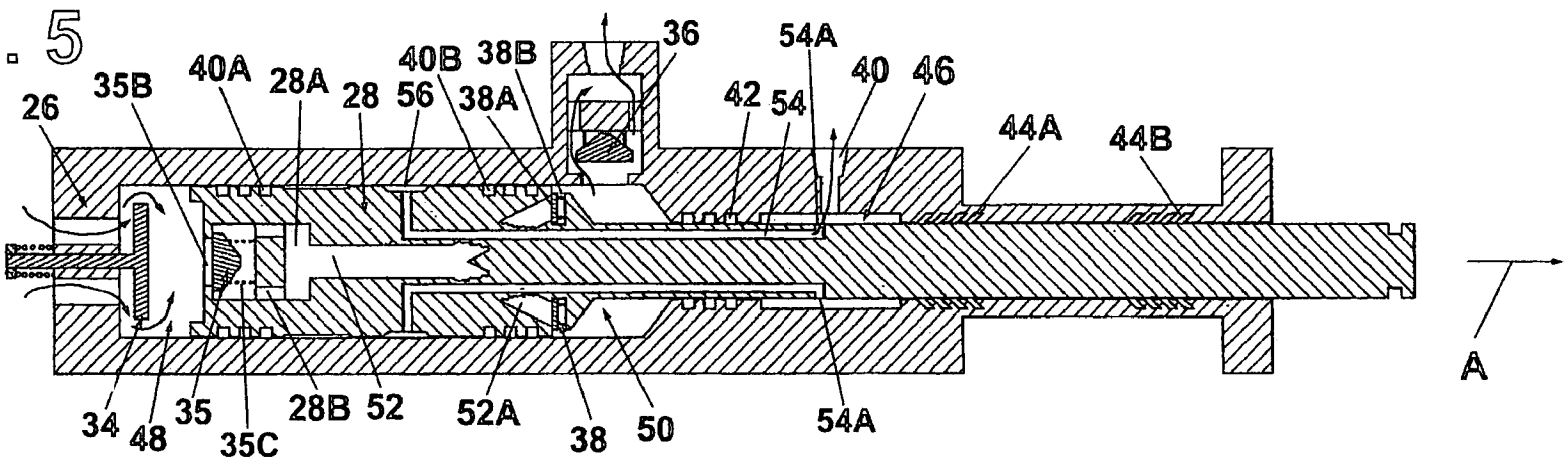
FIGS. 5-8 are longitudinal sectional views like that of FIG. 2 but showing the various stages of operation of the apparatus, depending on whether liquid or gas is the working fluid being handled by the apparatus.
Figure 6:
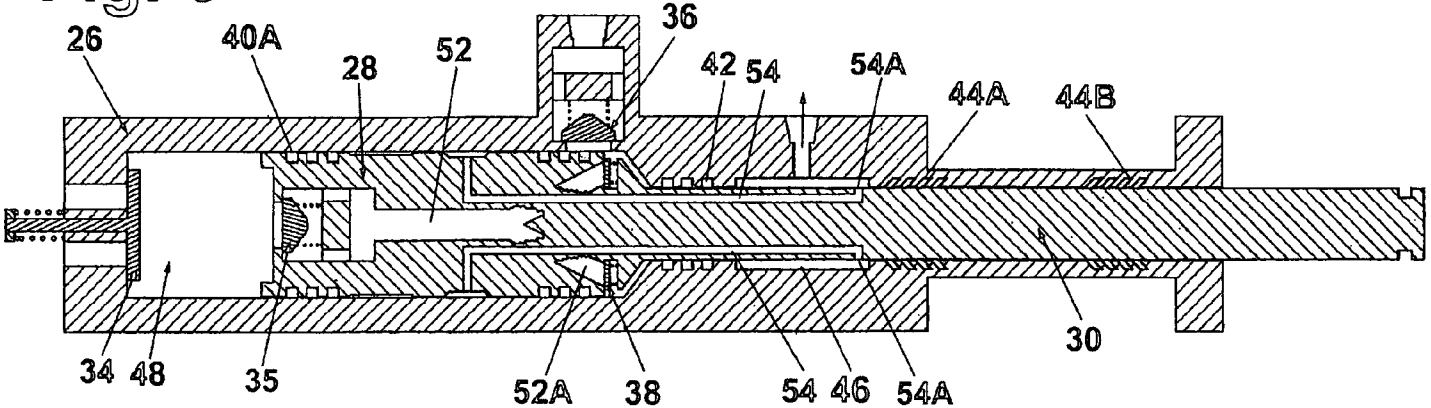
Figure 7:
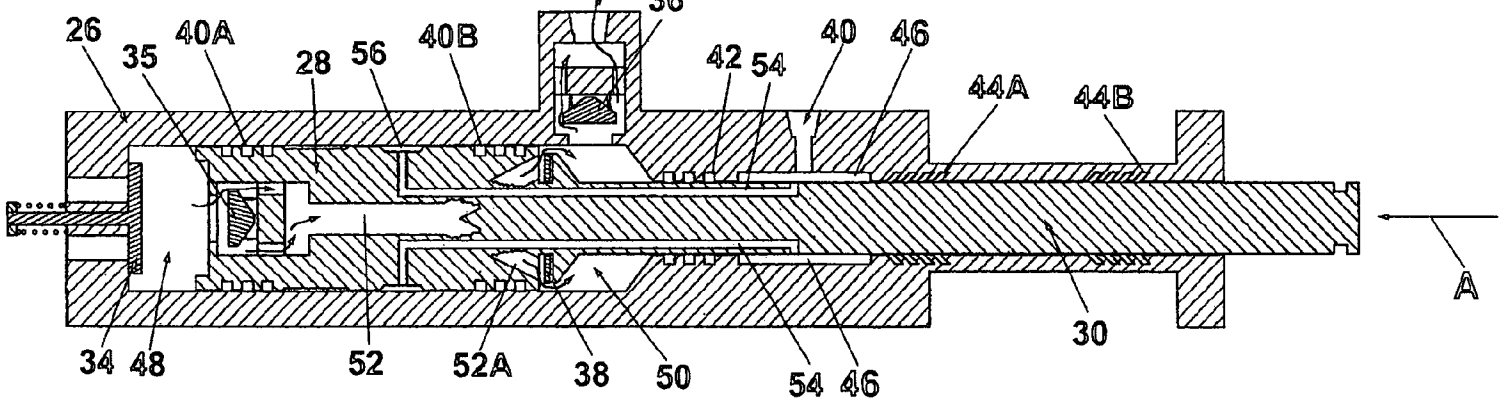

The inlet valve 34, to be described later, is similar to a one-way check valve in that it allows the fluid 3 into an inlet stage compression chamber 48 (in this exemplary two stage device the inlet stage makes up a first stage or first chamber) as the piston 28 is driven to the right during the "suction" stroke as shown in FIG. 5 and as will be described later. At the same time, the first stage discharge valve is closed and fluid 3 is expelled from an outlet stage compression chamber 50 (in this exemplary two stage device the outlet stage makes up a second stage or second chamber) through the discharge valve 36, which also is similar to a one-way check valve, and whose details will also be described later. The second or interstage suction valve, 38, whose details will be described later, is closed during the suction stroke. When the piston 28 reaches the end of its travel, as shown in FIG. 6, it momentarily stops and reverses direction, whereupon it moves to the left as shown in FIG. 7. This action constitutes the "compression" stroke. In particular, as the piston 28 begins the compression stroke the inlet valve 34 closes, and the second or interstage suction valve 38 opens. Fluid 3 then passes through a central passageway 52 (to be described later) in the piston 28 into the second stage of the device. Depending on the compressibility of the fluid and system pressures, the fluid also may be expelled from the discharge valve. The volume of the second stage chamber is substantially less than the volume of the first stage, generally ½ to ⅓ the volume of the first stage. Thus, if the fluid 3 is an incompressible fluid, e.g., liquid 3A, it will pass through the device and out the discharge valve 36. If the fluid is compressible, e.g., vapor or gas 3B, the fluid will be compressed to a higher density, dependent on system pressures and fluid conditions, and the compressed gas will stay inside the second compression chamber 50.

Figure 3:
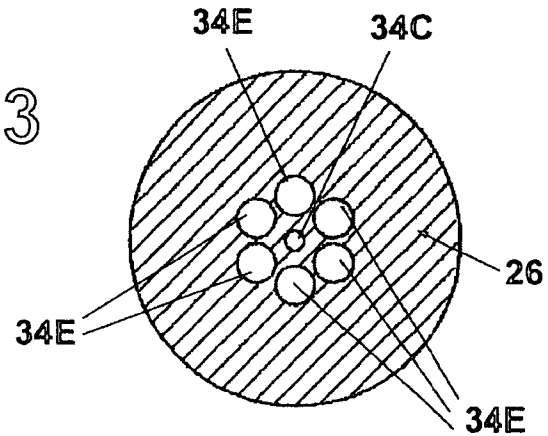
FIG. 3 is an enlarged sectional view taken along line 3-3 of FIG. 2.

In the exemplary embodiment shown herein, spring-loaded valves are used for the inlet valve 34, the first stage discharge valve 35, the second stage discharge valve 36 and the second or interstage suction valve 38. However, persons skilled in the art will recognize that other types of valves may be used, such as valves having other types of biasing means and/or operating means. The inlet valve 34 basically comprises a poppet having a flanged head 34A mounted on the end of a shaft 34B. The shaft extends through a central guide hole 34C (FIG. 3) in a portion of the wall of the housing 26. The poppet is biased by a helical compression spring 34D extending about the shaft 34B. The underside of the poppet's flange is disposed confronting a plurality of axially extending, equidistantly spaced ports 34E in a portion of the wall of the housing contiguous with the first stage chamber 48. These ports serve as the inlet to the device. The inner end of each of these ports is in the form of a flat surrounding surface, which acts as a valve seat for the poppet head 34A.

Figure 4:
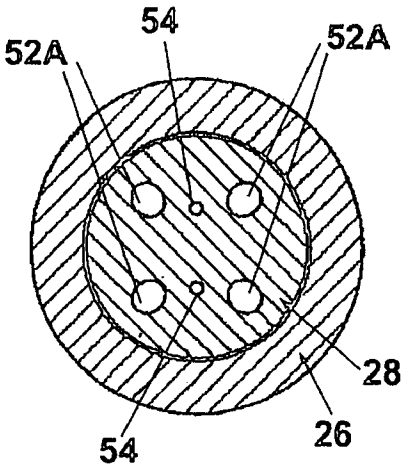
FIG. 4 is an enlarged sectional view taken along line 4-4 of FIG. 2.

The first stage discharge valve 35 basically comprises a poppet having a head 35A mounted within a recess 28A in the piston head 28 over a central opening 35B on the end of the piston head. The opening 35B is in fluid communication with the first stage chamber 48. The poppet head 35A is biased by a helical compression spring 35C located within the recess 28A. The recess 28A is in fluid communication with the central passageway 52 in the piston rod via plural openings 28B. As best seen in FIGS. 2 and 4 the central passageway includes internal porting in the form of angularly oriented passageways 52A extending from the central passageway 52 to the rear (right hand) side of the piston head. It is through the central passageway and the communicating angularly extending passageways 52A that the first stage chamber 48 and the second stage chamber 50 can be brought into fluid communication with each other. Such communication is effected by the second or interstage suction valve 38.

That valve basically comprises a poppet 38A which is located within the second stage chamber 50 so that it confronts the open ends of the angularly extending passageways 52A. The poppet 38A is biased by a helical compression spring 38B located between it and an annular flange 30A extending about the piston shaft 30.

The second stage discharge valve 36 is similar in construction to the first stage discharge valve 35. Thus, it basically comprises a poppet having a head 36A mounted within a recess 28C in a radially projecting portion of the housing 28 and over an opening 36B in a portion of the wall of the housing 28 in fluid communication with the second stage chamber 50. The poppet head 36A is biased by a helical compression spring 36B located within the recess 28C. The recess 28C is in fluid communication with the pipe or conduit 11.

The piston rings 40A serve as the first stage piston rings and are located about the outer periphery of the piston head 28 closely adjacent the first stage discharge valve 35. The piston rings 40B serve as the second stage piston rings and are located about the outer periphery of the piston head closely adjacent the second or interstage suction valve 38. The structure and operation of each set of piston rings 40A and 40B is discussed in greater detail in published United States Letters Patent Application 20020145259, entitled "Directional, Low-Leakage Seal Assembly," which is assigned to the same assignee as this invention and whose disclosure is incorporated herein by reference. The high pressure shaft seals 42 are conventional devices which are located immediately adjacent the second stage chamber 50 within annular recesses in the inner periphery of the housing 26 through which the piston shaft 30 extends.

The piston rings 40A and 40B and the high pressure shaft seals 42 are of the segmented or split type rings that can accommodate significant material loss due to wear. As is known such rings exhibit some minor leakage. Thus, to accommodate that leakage and channel it out of the device's housing for reuse, the piston is fitted with internal porting. In particular, as best seen in FIGS. 2 and 4, a plurality of passageways 54 extend radially inward from an annular recess 56 extending about the outer periphery of the piston head between the piston rings 40A and 40B. The passageways 54 then extend longitudinally down the interior of the piston head and contiguous shaft and terminate at respective ports 54A in the piston shaft located between the sealing rings 42 and the low pressure shaft seals 44. The ports 54A are in fluid communication with the annular space 46 in the housing 26 contiguous with the blowby port 40.

As mentioned earlier, the pumping-compressing apparatus 20 has two stages of compression. The first stage has for its boundary the suction valve poppet 34A, portions of the interior walls of the housing 26, the piston head 28, the first stage piston rings 40A and the first stage discharge valve 35. The second stage has for its boundary the second or interstage suction valve 38, portions of the cylindrical interior walls of the housing 26, the piston head 28, the second stage piston rings 40B, the second stage shaft seal rings 42, and second stage discharge valve 36.

The annular channel or recess 46 serves as a collection space for the blowby fluid. Contiguous with this collection space is a threaded port which serves as blowby port to allow gas or liquid to be piped away from the pumping-compressing apparatus 20 at low pressure to pipe or conduit 11. The blowby port needs to be at low pressure so that suitable low pressure shaft seals can be incorporated into the shaft as shown to the right of the blowby port. These seals are of a non-segmented design in order to be virtually bubble (gas) tight since a leak-proof design is of considerable importance for this location. As is known, non-segmented seal designs do not have the ability to wear or loose material as well as segmented designs. Thus, the non-segmented seals should not be exposed to high pressure which will result in their rapid wear. With the construction of the device as shown and described, the shaft seals only seal against low pressure, thus minimizing wear and maximizing their longevity.

FIGS. 5 through 8 show various stages of operation of the pumping-compressing apparatus 20, depending on whether liquid 3A or gas 3B is the working fluid 3. In particular, FIG. 5 shows the device during the suction stroke, with piston motion to the right as shown by the arrow A. At this point in the operation of the apparatus, the inlet (suction) valve 34 opens and allows the fluid 3 to pass through it as shown by the arrows. The first stage discharge valve 35 and second or interstage suction valve 38 are closed at this time since the spring load and pressure holds them shut. The second stage chamber 50 is always discharging during this stroke through the open discharge valve 36, regardless of whether the fluid is a liquid or gas. At the end of its travel, the piston 28 comes to a stop as shown in FIG. 6. The valves 34, 35, 38 and 36 all close at this time due to the load provided by their associated springs. Thus all flow stops. However, blowby fluid 3 still can slip past the first stage piston ring seals 40A into the annular recess 56 and through the communicating passageways 54 to the annular recess 46 in the housing. Since the recess 46 is in fluid communication with the blowby port 40, the blowby fluid is routed out of that port for return to either the suction input of the apparatus 20 or to the tank 2 as described earlier. Any blowby fluid getting past the second stage piston rings 40B and the second stage shaft seal rings 42 directly enters the annular recess 56 for routing out of the apparatus 20 in a similar manner.

Figure 8:
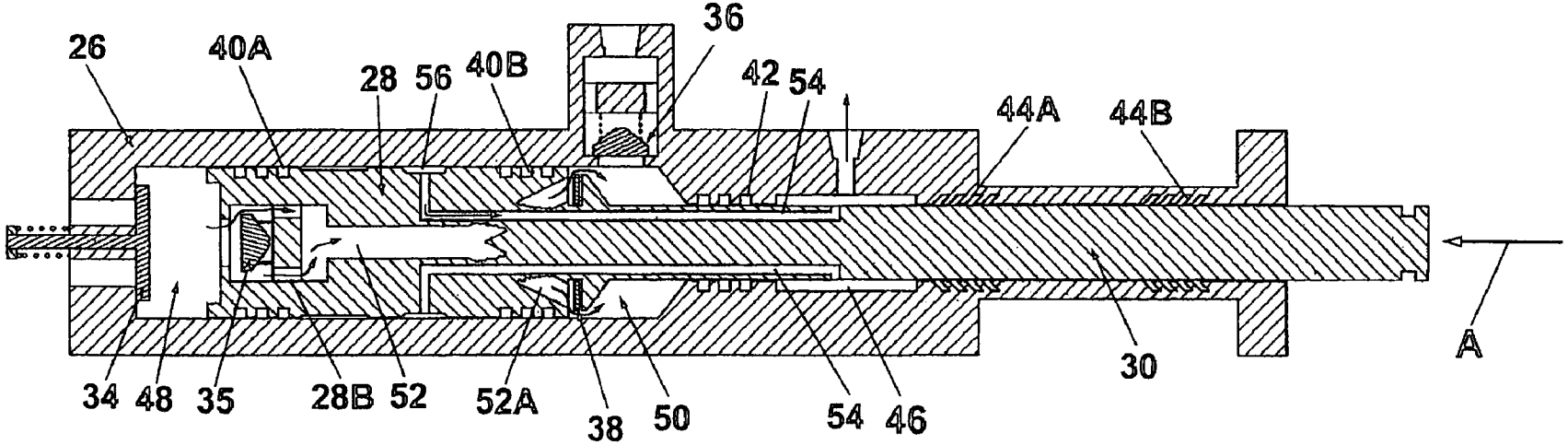

FIG. 7 shows the next stage of the cycle of operation of the apparatus 20, i.e., the compression stroke wherein the piston 28 moves to the left as shown by arrow A. During this operation any fluid inside the first stage chamber 48 is compressed. As mentioned earlier, the second stage chamber has a much smaller volume than the first stage chamber. Because of this the second stage will also be discharging the fluid 3, if the fluid is an incompressible liquid. FIG. 7 shows the apparatus 20 operation assuming that a liquid is being discharged, with the first and second stage discharge valves being open and the second or interstage suction valve open. If only gas is being compressed, it is not expelled from the compressor during this discharge stroke unless the discharge pressure is low relative to the suction pressure. Instead, the second stage discharge valve closes and is held closed by high pressure. Flow only moves from the first stage, through the interstage porting inside the piston, and into the second stage. This operation is shown in FIG. 8.

As should be appreciated from the foregoing, the subject invention enables one to use a single multistage device for applications involving the handling of liquids and gases by merely changing the speed of the pumping/compressing stroke to one that is best suited for the particular fluid phase encountered. This provides various economic advantages over the more complex and/or duplicative (use of a separate pump and a separate compressor) arrangements of the prior art. Moreover, the multistage device can make use of any type of driving motor.

It should be noted at this juncture that the pumping-compressing apparatus 20 need not be a two stage device like the exemplary embodiment described above. Thus, the multistage device can include three or more stages. Moreover, the multistage device need not be limited to having a single reciprocating piston. Thus, the subject invention contemplates multistage devices making use of plural pistons. Further still the apparatus of this invention need not make use of a blowby valve and associated components when used in a fluid handling system, although for cryogenic applications, such an arrangement is preferred. In any case as should be appreciated from the foregoing, the subject invention provides a single, multispeed device capable of handling both liquid and gas of a cryogenic fluid on a viable, cost effective basis.

While the invention has been described in detail and with reference to specific examples thereof, it will be apparent to one skilled in the art that various changes and modifications can be made therein without departing from the spirit and scope thereof.

We claim:

1. A pumping/compressing apparatus for use in a fluid handling system transferring a fluid from one location to another location or to an end user, said pumping/compressing apparatus comprising a multistage device and a motor, the fluid handling system comprising a vessel for holding the fluid, a vapor valve and a liquid valve, the fluid comprising a liquid, gas and/or combination thereof, the vessel being coupled to the vapor valve and to the liquid valve, the vapor valve and the liquid valve being coupled to said multistage device, whereupon gas from the vessel may flow to the device via the vapor valve and liquid from the vessel may flow to the device via the liquid valve, said multistage device being arranged for pumping and/or compressing the fluid, said multistage device comprising at least one reciprocating piston, a first stage chamber, a second stage chamber, an inlet, and an outlet, said inlet being coupled to said first stage chamber, said outlet being coupled to said second stage chamber, said piston including a portion in communication with said first stage chamber and a portion in communication with said second stage chamber, said first stage chamber being arranged to be brought into fluid communication with said second stage chamber, said piston being coupled to said motor and arranged to be reciprocated at respective first and second speeds, said second reciprocating speed being higher than said first reciprocating speed, whereupon when said at least one piston is reciprocated at said first reciprocating speed said multistage device can effectively pump liquid or mostly liquid fluids from said second stage chamber to said outlet and when said at least one piston is reciprocated at said second reciprocating speed said multistage device can effectively compress gas or mostly gas fluids in said second stage chamber and provide said gas or mostly gas fluid to said outlet, an annular recess positioned on said piston in fluid communication with a blowby port by a fluid passageway formed within the piston, said at least one piston including at least one piston seal selectively isolating said second stage chamber from said annular recess and thereby said blowby port, said piston seal being arranged to selectively operate to enable a blowby portion of the fluid in said second stage chamber to flow to said annular recess and said blowby port.

2. The apparatus of claim 1 wherein said motor is a variable speed motor for causing said at least one piston to be reciprocated at said first or second reciprocating speeds.

3. The apparatus of claim 1 additionally comprising a transmission coupled between said motor and said at least one reciprocating piston for causing said at least one piston to be reciprocated at said first or second reciprocating speeds.

4. The apparatus of claim 1, wherein the fluid handling system includes a blowby valve and wherein said blowby port of said apparatus is coupled to said inlet of said multistage device and to said blowby valve to enable said blowby portion of the fluid to flow back to said vessel and to said inlet of said multistage device.

5. The apparatus of claim 1 wherein said multistage device comprises a two stage device and wherein said first stage chamber is an inlet chamber, said second stage chamber is an outlet chamber, said at least one piston comprises a portion in communication with said inlet chamber and a portion in communication with said outlet chamber.

6. The apparatus of claim 5 wherein said at least one piston comprises a single piston.

7. A fluid handling system for transferring a fluid from one location to another location or to an end user, said fluid handling system comprising a vessel for holding the fluid, a vapor valve, a liquid valve, a pumping/compressing apparatus for pumping and/or compressing said fluid, said pumping/compressing apparatus comprising a multistage device and a motor, said fluid comprising a liquid, gas and/or combination thereof, said vessel being coupled to said vapor valve and to said liquid valve, said vapor valve and said liquid valve being coupled to said multistage device, whereupon gas from said vessel may flow to said multistage device via said vapor valve and liquid from said vessel may flow to said multistage device via said liquid valve, said multistage device comprising at least one reciprocating piston, an inlet stage chamber, an outlet stage chamber, an inlet, and an outlet, said inlet being coupled to said inlet stage chamber, said outlet being coupled to said outlet stage chamber, said at least one piston including a portion in communication with said inlet stage chamber, said inlet stage chamber being arranged to be brought into fluid communication with said outlet stage chamber, said at least one piston being arranged to be reciprocated by said motor at multiple speeds comprising at least respective first and second speeds, said second reciprocating speed being higher than said first reciprocating speed, whereupon when said at least one piston is reciprocated at said first reciprocating speed said multistage device can effectively pump liquid or mostly liquid fluids from said outlet stage chamber to said outlet and when said at least one piston is reciprocated at said second reciprocating speed said multistage device can effectively compress gas or mostly gas fluids in said outlet stage chamber and provide said gas or mostly gas fluids to said outlet, an annular recess positioned on said piston in fluid communication with a blowby port by a fluid passageway formed within the piston, said at least one piston including at least one piston seal selectively isolating said outlet stage chamber from said annular recess and thereby said blowby port, said piston seal being arranged to selectively operate to enable a blowby portion of the fluid in said outlet stage chamber to flow to said annular recess and said blowby port.

8. The system of claim 7 wherein said motor is a variable speed motor for causing said at least one piston to be reciprocated at said first or second reciprocating speeds.

9. The system of claim 7 additionally comprising a transmission coupled between said motor and said at least one reciprocating piston for causing said at least one piston to be reciprocated said first or second reciprocating speeds.

10. The system of claim 7 additionally comprising a blowby valve and wherein said blowby port is coupled to said inlet of said multistage device and to said blowby valve to enable said blowby portion of the fluid to flow back to said vessel and to said inlet of said multistage device.

11. The system of claim 7 wherein said multistage device comprises a two stage device and wherein said inlet stage chamber is a first stage chamber, said outlet stage chamber is a second stage chamber, said at least one piston comprises a portion in communication with said first stage chamber and a portion in communication with said second stage chamber.

12. The system of claim 7 wherein said at least one piston comprises a single piston.

* * * * *